US009329530B1

(12) United States Patent
Ozawa

(10) Patent No.: US 9,329,530 B1
(45) Date of Patent: May 3, 2016

(54) DEVELOPING DEVICE AND IMAGE FORMING APPARATUS INCLUDING THE SAME

(71) Applicant: FUJI XEROX CO., LTD., Tokyo (JP)

(72) Inventor: Hideaki Ozawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/816,761

(22) Filed: Aug. 3, 2015

(30) Foreign Application Priority Data

Feb. 24, 2015 (JP) ..... 2015-033679

(51) Int. Cl.
*G03G 15/00* (2006.01)
*G03G 15/08* (2006.01)

(52) U.S. Cl.
CPC ..... *G03G 15/0898* (2013.01); *G03G 15/0812* (2013.01)

(58) Field of Classification Search
CPC ..... G03G 15/0812; G03G 15/0898; G03G 15/0817; G03G 15/0942; G03G 21/181; G03G 2215/0098
USPC ..... 399/103
See application file for complete search history.

(56) References Cited

U.S. PATENT DOCUMENTS

2007/0242973 A1* 10/2007 Yaji ..... G03G 15/0817 399/103
2013/0071138 A1* 3/2013 Goto ..... G03G 15/0812 399/103
2013/0142541 A1* 6/2013 Hayashida ..... G03G 15/0898 399/106

FOREIGN PATENT DOCUMENTS

| | | | |
|---|---|---|---|
| JP | 02-073384 | A | 3/1990 |
| JP | 07-219341 | A | 8/1995 |
| JP | 2013-254038 | A | 12/2013 |
| JP | 2013-254147 | A | 12/2013 |

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A developing device includes a developer-thickness-regulating member having a substantially circular sectional shape and that regulates a thickness of a developer layer on a developer carrier at a regulating gap between the developer carrier and the developer-thickness-regulating member, and sealing members that seal a gap between the developer-thickness-regulating member and a developing-device housing and include first sealing members provided at two ends of the developer-thickness-regulating member and on outer sides of an effective developer-transporting area, the first sealing members preventing rotation of the developer-thickness-regulating member by being in contact with the developer-thickness-regulating member at first portions excluding a portion opposite the regulating gap; and a second sealing member extending over the effective developer-transporting area and provided at a second portion excluding the portion opposite the regulating gap, the second sealing member being in contact with the developer-thickness-regulating member at a pressure lower than a pressure from the first sealing members.

9 Claims, 14 Drawing Sheets

DEVELOPING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2015-033679 filed Feb. 24, 2015.

BACKGROUND

Technical Field

The present invention relates to a developing device and an image forming apparatus including the same.

SUMMARY

According to an aspect of the invention, there is provided a developing device including a developing-device housing that has an opening facing an image carrier on which an electrostatic latent image is to be formed, the developing-device housing containing developer including toner and a carrier; a developer carrier that faces the image carrier and is rotatable while carrying the developer, the developer carrier being configured to develop the electrostatic latent image on the image carrier with the developer; a developer-thickness-regulating member that is a substantially long magnetic member having a substantially circular sectional shape and extending parallel to an axial direction of the developer carrier, the developer-thickness-regulating member facing the developer carrier at a position on an upstream side in a direction of rotation of the developer carrier with respect to a position where the developer carrier faces the image carrier, the developer-thickness-regulating member being configured to regulate a thickness of a layer of the developer on the developer carrier at a regulating gap provided between the developer carrier and the developer-thickness-regulating member; and sealing members that seal a gap between the developer-thickness-regulating member and the developing-device housing. The sealing members include first sealing members provided at two respective ends of the developer-thickness-regulating member, the ends being on respective outer sides of an effective developer-transporting area of the developer carrier, the first sealing members preventing rotation of the developer-thickness-regulating member by being in contact with the developer-thickness-regulating member at respective first portions of the gap between the developer-thickness-regulating member and the developing-device housing excluding a portion across the developer-thickness-regulating member from the regulating gap, the first sealing members sealing the respective first portions; and a second sealing member extending over an area of the developer-thickness-regulating member that corresponds to the effective developer-transporting area of the developer carrier, the second sealing member being provided at a second portion of the gap between the developer-thickness-regulating member and the developing-device housing excluding the portion across the developer-thickness-regulating member from the regulating gap, the second sealing member being in contact with the developer-thickness-regulating member at a contact pressure lower than a contact pressure at which the first sealing members are in contact with the developer-thickness-regulating member, the second sealing member sealing the second portion.

BRIEF DESCRIPTION OF THE DRAWINGS

Exemplary embodiments of the present invention will be described in detail based on the following figures, wherein.

DETAILED DESCRIPTION

General Exemplary Embodiment

Figure 1A:
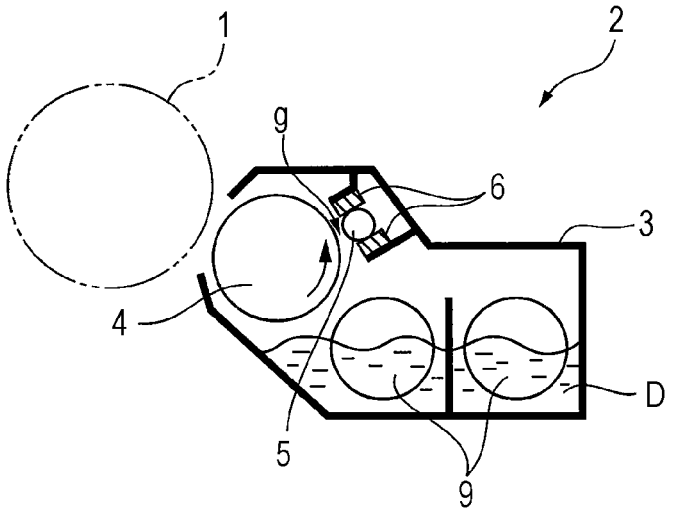
FIG. 1A illustrates an outline of a developing device according to a general exemplary embodiment of the present invention.
Figure 1B:
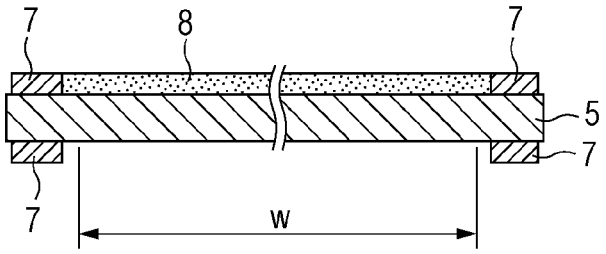
FIG. 1B illustrates an exemplary state of a developer-thickness-regulating member included in the developing device illustrated in FIG. 1A.

FIG. 1A illustrates an outline of a developing device 2 according to a general exemplary embodiment of the present invention. FIG. 1B illustrates an exemplary state of a developer-thickness-regulating member 5, to be described below, included in the developing device 2 illustrated in FIG. 1A. In the case illustrated in FIG. 1B, two longitudinal-direction ends of the developer-thickness-regulating member 5 are each held between first sealing members 7, to be described below, provided on both sides (on the upper side and on the lower side in FIG. 1B), respectively, thereof.

Referring to FIGS. 1A and 1B, the developing device 2 includes a developing-device housing 3 that has an opening facing an image carrier 1 on which an electrostatic latent image is to be formed, the developing-device housing 3 containing developer D including toner and a carrier; a developer carrier 4 that faces the image carrier 1 and is rotatable while carrying the developer D, the developer carrier 4 being configured to develop the electrostatic latent image on the image carrier 1 with the developer D; the developer-thickness-regulating member 5 that is a long or substantially long magnetic member having a circular or substantially circular sectional shape and extending parallel to an axial direction of the developer carrier 4, the developer-thickness-regulating member 5 facing the developer carrier 4 at a position on an upstream side in a direction of rotation of the developer carrier 4 with respect to a position where the developer carrier 4 faces the image carrier 1, the developer-thickness-regulating member 5 being configured to regulate a thickness of a layer of the developer D on the developer carrier 4 at a regulating gap g provided between the developer carrier 4 and the developer-thickness-regulating member 5; and sealing members 6 that seal a gap between the developer-thickness-regulating member 5 and the developing-device housing 3. The sealing members 6 include the first sealing members 7 provided at two respective ends of the developer-thickness-regulating member 5, the ends being on respective outer sides of an effective developer-transporting area w of the developer carrier 4, the first sealing members 7 preventing rotation of the developer-thickness-regulating member 5 by being in contact with the developer-thickness-regulating member 5 at respective first portions of the gap between the developer-thickness-regulating member 5 and the developing-device housing 3 excluding a portion across the developer-thickness-regulating member 5 from the regulating gap g, the first sealing members 7 sealing the respective first portions; and a second sealing member 8 extending over an area of the developer-thickness-regulating member 5 that corresponds to the effective developer-transporting area w of the developer carrier 4, the second sealing member 8 being provided at a second portion of the gap between the developer-thickness-regulating member 5 and the developing-device housing 3 excluding the portion across the developer-thickness-regulating member 5 from the regulating gap g, the second sealing member 8 being in contact with the developer-thickness-regulating member 5 at a contact pressure lower than a contact pressure at which the first sealing members 7 are in contact with the developer-thickness-regulating member 5, the second sealing member sealing the second portion. Referring to FIG. 1A, the developing device 2 further includes stirring-and-transporting members 9 provided in the back of the developing-device housing 3 with respect to the developer carrier 4. The stirring-and-transporting members 9 supply the developer D to the developer carrier 4 while stirring and transporting the developer D.

The developer carrier 4 as described above further includes plural magnetic poles fixedly provided thereinside so as to carry and transport the developer D, and a nonmagnetic metal sleeve made of stainless steel or the like and rotatably provided over the magnetic poles. The number of stirring-and-transporting members 9 is not limited but may be two, typically, so as to allow the developer D to circulate in the developing-device housing 3.

The developer-thickness-regulating member 5 is made of a magnetic material such as pure iron, magnetic stainless steel, or nickel-plated brass. The present inventor has found that the shape of the developer-thickness-regulating member 5 that regulates the thickness of the layer of the developer D changes in very different ways between a case where the developer-thickness-regulating member 5 is made of a magnetic material and a case where the developer-thickness-regulating member 5 is made of a nonmagnetic material. Now, the change in the shape of the developer-thickness-regulating member 5 that varies with the material thereof will be described.

Figure 2A:
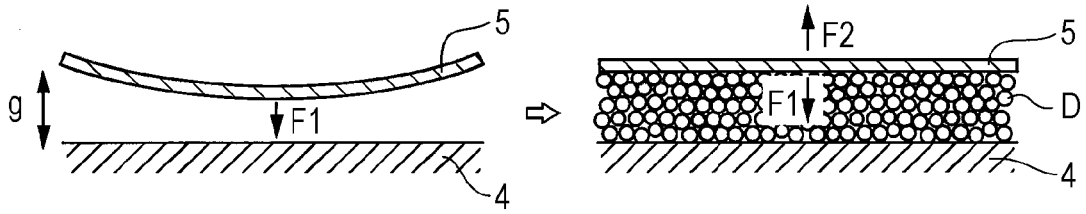
FIG. 2A illustrates the positional relationship between a developer carrier and the developer-thickness-regulating member according to the general exemplary embodiment.
Figure 2B:
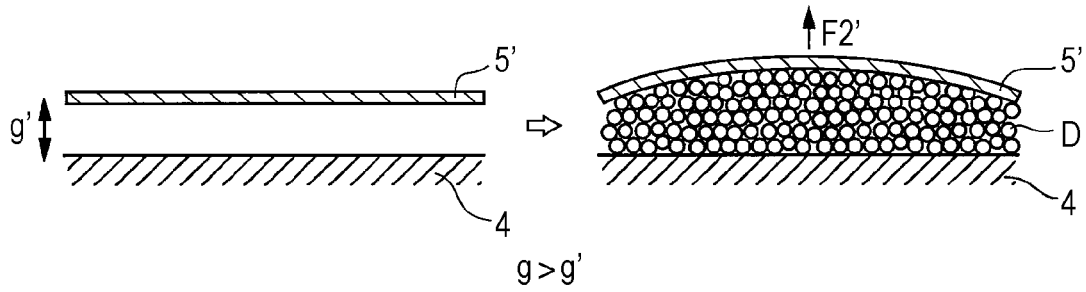
FIG. 2B illustrates the positional relationship between the developer carrier and a comparative developer-thickness-regulating member that is nonmagnetic.

FIG. 2A schematically illustrates the positional relationship between the developer carrier 4 and an exemplary developer-thickness-regulating member 5 that is magnetic as in the general exemplary embodiment. FIG. 2B schematically illustrates the positional relationship between the developer carrier 4 and a comparative developer-thickness-regulating member 5' that is nonmagnetic. The developer-thickness-regulating members 5 and 5' are both unrotatable.

Referring to FIG. 1A, when the developer-thickness-regulating member 5 is magnetic as in the general exemplary embodiment, one of the magnetic poles provided in the developer carrier 4 (specifically, the magnetic pole provided at a position corresponding to the developer-thickness-regulating member 5) attracts the developer-thickness-regulating member 5. In such a case, when no developer D is present between the developer carrier 4 and the developer-thickness-regulating member 5, the developer-thickness-regulating member 5 is attracted toward the developer carrier 4 under a magnetic attractive force F1 exerted by the developer carrier 4, and the developer-thickness-regulating member 5 is bent with a central portion thereof being depressed in such a manner as to narrow the regulating gap g. When the developer carrier 4 starts to carry and transport the developer D, a force (a developer pressure F2) generated by the flow of the developer D and acting in a direction away from the developer carrier 4 is applied to the developer-thickness-regulating member 5, and the depressed central portion of the developer-thickness-regulating member 5 returns to its original position. Such an effect optimizes the developer-thickness-regulating member 5. Moreover, employing the magnetic developer-thickness-regulating member 5 increases the length of bristles of the developer D that is to be regulated. Hence, the regulating gap g is allowed to be made larger than in the case of the nonmagnetic developer-thickness-regulating member 5', which will be described below. Therefore, the flow of the developer D is stabilized even if, for example, any particles of the developer D flocculate. Thus, the thickness of the layer of the developer D is regulated effectively.

Referring now to FIG. 2B illustrating the case of the comparative developer-thickness-regulating member 5' that is nonmagnetic, when no developer D is present between the developer carrier 4 and the developer-thickness-regulating member 5', the size of a regulating gap g' is uniform. However, when the developer carrier 4 starts to carry and transport the developer D, a developer pressure F2' bends the developer-thickness-regulating member 5' by pushing a central portion of the developer-thickness-regulating member 5' in a direction away from the developer carrier 4. Therefore, the thickness of the layer of the developer D is not regulated appropriately, leading to possible nonuniformity in the resulting image. Moreover, the length of bristles of the developer D that is to be regulated in the case of the nonmagnetic developer-thickness-regulating member 5' is shorter than in the case of the magnetic developer-thickness-regulating member 5. Hence, the size of the regulating gap g' needs to be made smaller than in the case of the magnetic developer-thickness-regulating member 5 (g>g'). Therefore, the developer D tends to clog the regulating gap g' if any particles of the developer D flocculate, leading to a possible defect, such as white lines, in the resulting image.

In the general exemplary embodiment, referring now to FIG. 1B, the first sealing members 7 are provided so as to prevent the developer-thickness-regulating member 5 from rotating when the developer D passes through the regulating gap g. If the developer-thickness-regulating member 5 rotates, the magnetism produced between the developer carrier 4 and the developer-thickness-regulating member 5 becomes unstable, leading to possible nonuniformity in the thickness of the layer of the developer D that is obtained after the regulation. Consequently, the resulting image may have a defect such as nonuniformity. To prevent the developer-thickness-regulating member 5 from rotating without using the first sealing members 7, the two ends of the developer-thickness-regulating member 5 may be fitted into the developing-device housing 3 with no play. In that case, however, the method of processing the developing-device housing 3 and the method of fitting the developer-thickness-regulating member 5 into the developing-device housing 3 need to be considered carefully, which leads to a cost increase. Instead, the two ends of the developer-thickness-regulating member 5 may each be processed into, for example, a D-shape in sectional view and be fitted into the developing-device housing 3. Such a method also accompanies a cost increase.

In the general exemplary embodiment, the first sealing members 7 have a function of preventing the developer D from spreading, from any positions other than the regulating gap g, over a portion of the developer carrier 4 that has undergone developer-thickness regulation, and the second sealing member 8 is provided in addition to the first sealing members 7. Therefore, the developer D is allowed to pass through only the regulating gap g. Thus, the amount of developer D on a portion of the developer carrier 4 that has passed through the regulating gap g is stabilized.

Now, more specific details of the general exemplary embodiment will be described with reference to FIGS. 1A to 2B.

In terms of preventing an excessive deformation of the developer-thickness-regulating member 5 provided with the first sealing members 7 and the second sealing member 8, the first and second portions of the gap between the developer-thickness-regulating member 5 and the developing-device housing 3 that are sealed by the first sealing members 7 and the second sealing member 8 may be on a virtual line extending in a direction substantially orthogonal to the regulating gap g. The direction substantially orthogonal to the regulating gap g refers to a direction substantially parallel to a tangent to the circumferential surface of the developer carrier 4 in the regulating gap g, and the first sealing members 7 and the second sealing member 8 may be on a virtual line extending in that direction. In such a configuration, the contact pressure applied to the developer-thickness-regulating member 5 by providing the sealing members 6 includes only a small component acting in such a direction as to change the size of the regulating gap g (in a direction that is normal to the developer carrier 4), and the size of the regulating gap g is further stabilized.

In terms of increasing the flexibility in the arrangement of the sealing members 6, the first sealing members 7 and the second sealing member 8 may be aligned in a longitudinal direction of the developer-thickness-regulating member 5 in at least one portion of the gap between the developer-thickness-regulating member 5 and the developing-device housing 3. In a case where the first sealing members 7 and the second sealing member 8 are aligned in the longitudinal direction of the developer-thickness-regulating member 5, the sealability of the sealing members 6 is improved. Furthermore, the first sealing members 7 and the second sealing member 8 are allowed to be provided as one integral member. Furthermore, the method of attaching the sealing members 6 to the developing device 2 is simplified. Furthermore, the flexibility in the arrangement of the sealing members 6 is increased.

In terms of enhancing the effect produced by the first sealing members 7 that prevent the rotation of the developer-thickness-regulating member 5, the first sealing members 7 provided at the two respective ends of the developer-thickness-regulating member 5 may each be one of plural first sealing members 7 that are provided at respective positions on a circumference of the developer-thickness-regulating member 5 in the gap between the developer-thickness-regulating member 5 and the developing-device housing 3.

In terms of effectively producing the effect of providing the sealing members 6, the first sealing members 7 at each of the two ends of the developer-thickness-regulating member 5 may be provided at two respective positions that are on opposite sides of the developer-thickness-regulating member 5, and the second sealing member 8 may extend over a space between two of the first sealing members that are on a downstream side in a direction of rotation of the developer carrier 4. In such a configuration, since each of the ends of the developer-thickness-regulating member 5 are held between the two first sealing members 7, the developer-thickness-regulating member 5 is expected to be fully prevented from rotating. Furthermore, since the second sealing member 8 is provided between the two first sealing members 7 that are on the downstream side, a satisfactory amount of developer D is supplied to the regulating gap g. Furthermore, the occurrence of stagnation of the developer D near the regulating gap g is suppressed. Needless to say, in such a configuration also, the first sealing members 7 may be provided in such a manner as to seal the portions that are on a virtual line extending in the direction substantially orthogonal to the regulating gap g, as described above.

To enhance the effect of preventing the rotation of the developer-thickness-regulating member 5, the first sealing members 7 may each have a surface characteristic that applies a frictional force to the developer-thickness-regulating member 5, the frictional force preventing the rotation of the developer-thickness-regulating member 5. To provide such a surface characteristic, the surface roughness of the first sealing members 7 may be increased, or a foamed sponge layer or an adhesive layer may be provided on the surface of each of the first sealing members 7.

To prevent the rotation of the developer-thickness-regulating member 5, the first sealing members 7 may prevent the rotation of the developer-thickness-regulating member 5 while being pressed by the developing-device housing 3.

According to another aspect of the invention, there is provided an image forming apparatus including an image carrier 1 on which an electrostatic latent image is to be formed, and the developing device 2 described above. The image forming apparatus may further include a cleaning device that removes residual toner from the image carrier 1, and a refeeding mechanism that collects the toner removed by the cleaning device and refeeds the toner toward stirring-and-transporting members 9 included in the developing device 2.

More specific exemplary embodiments of the present invention will now be described in detail with reference to the accompanying drawings.

First Exemplary Embodiment

Overall Configuration of Image Forming Apparatus

Figure 3:
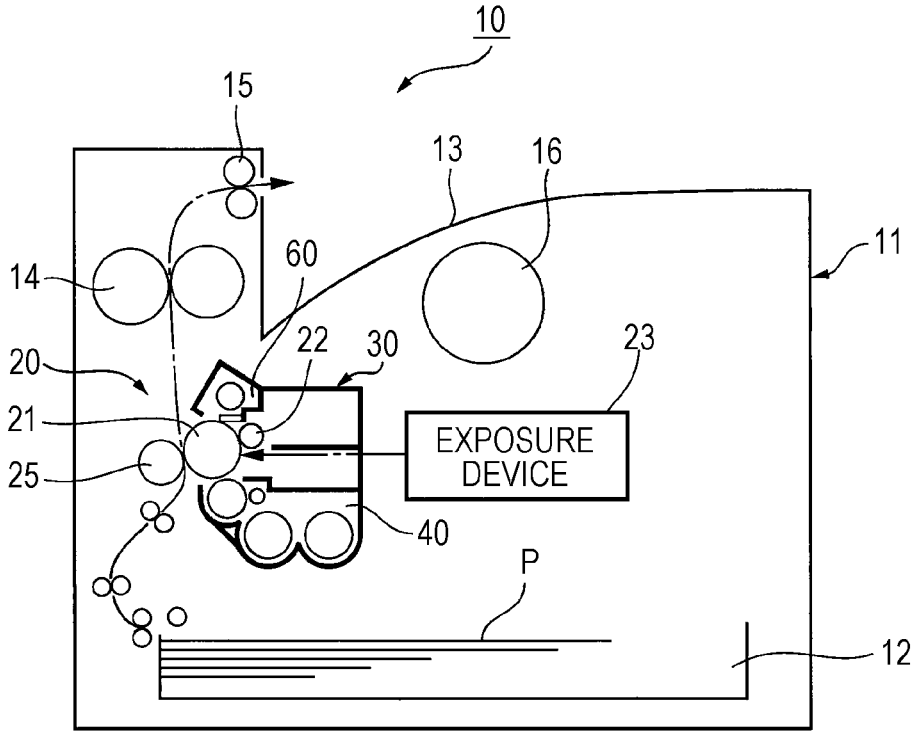
FIG. 3 illustrates an overall configuration of an image forming apparatus according to a first exemplary embodiment of the present invention.

FIG. 3 illustrates an overall configuration of an image forming apparatus 10 according to a first exemplary embodiment of the present invention.

Referring to FIG. 3, the image forming apparatus 10 is a monochrome printer that uses a two-component developer composed of toner and a carrier. The image forming apparatus 10 includes an image forming section 20 provided in an apparatus housing 11 and that forms a toner image on a recording material P, and a recording-material-supplying unit 12 provided in a lower part of the apparatus housing 11 and that supplies the recording material P to the image forming section 20. A portion of the upper surface of the apparatus housing 11 serves as a recording-material-receiving portion 13 onto which the recording material P having the toner image is discharged. The image forming apparatus 10 further includes, in the apparatus housing 11, a fixing device 14 that fixes the toner image formed on the recording material P by the image forming section 20 to the recording material P, and a pair of discharge rollers 15 that discharges the recording material P having the fixed toner image to the recording-material-receiving portion 13.

The image forming section 20 according to the first exemplary embodiment includes a photoconductor 21 as an image carrier, a charging device 22 that charges the photoconductor 21 to a predetermined charging potential, an exposure device 23 that exposes the charged photoconductor 21 to light and thus forms an electrostatic latent image on the photoconductor 21 (while an exposure method using laser light is employed in the first exemplary embodiment, any other known exposure method may be employed), a developing device 40 that develops the electrostatic latent image on the photoconductor 21 into a toner image by using the two-component developer, a transfer device 25 that transfers the toner image developed on the photoconductor 21 to the recording material P, a cleaning device 60 that cleans the photoconductor 21 that has undergone the transfer, and so forth. The image forming apparatus 10 further includes a toner supplying unit 16 that supplies fresh toner to the developing device 40.

In the first exemplary embodiment, the photoconductor 21, the charging device 22, the developing device 40, and the cleaning device 60 are integrated into a process unit 30 that is detachably provided in the apparatus housing 11. The toner image on the photoconductor 21 is transferred by the transfer device 25 to the recording material P supplied from the recording-material-supplying unit 12, and the recording material P having the toner image is transported through the fixing device 14 and is discharged by the pair of discharge rollers 15 onto the recording-material-receiving portion 13.

Configuration of Process Unit

Figure 4:
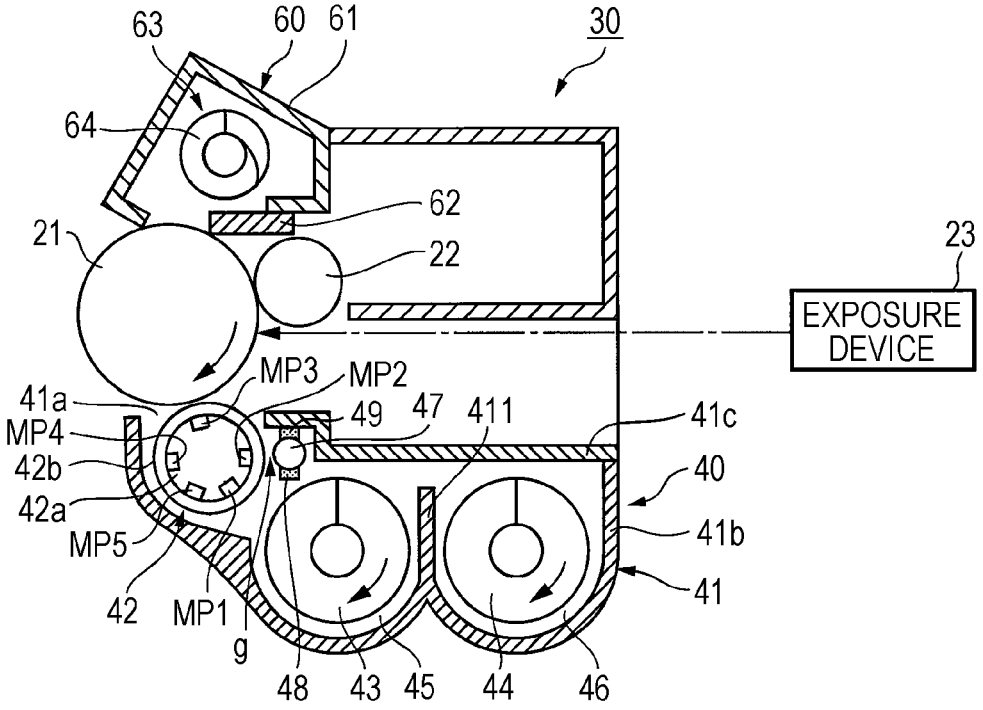
FIG. 4 is an enlarged view of a process unit according to the first exemplary embodiment.

FIG. 4 is an enlarged view of the process unit 30 according to the first exemplary embodiment.

In the process unit 30 illustrated in FIG. 4, the developing device 40 is provided below the photoconductor 21, and the cleaning device 60 is provided above the photoconductor 21.

Collected-Toner-Refeeding Mechanism

The first exemplary embodiment employs a configuration in which residual toner on the photoconductor 21 is collected and is fed back to the developing device 40 for reuse. Accordingly, the cleaning device 60 has the following feature.

Referring to FIG. 4, the cleaning device 60 according to the first exemplary embodiment includes a scraping member 62, for example, as a cleaning tool attached to a portion of a cleaning-device container 61 and that removes residual toner from the photoconductor 21, and a collected-toner-refeeding mechanism 63 provided in the cleaning-device container 61 and that collects the toner scraped off by the scraping member 62 and feeds the collected toner back into the developing device 40 for reuse. The collected-toner-refeeding mechanism 63 also includes a collected-toner-transporting member 64.

Figure 5:
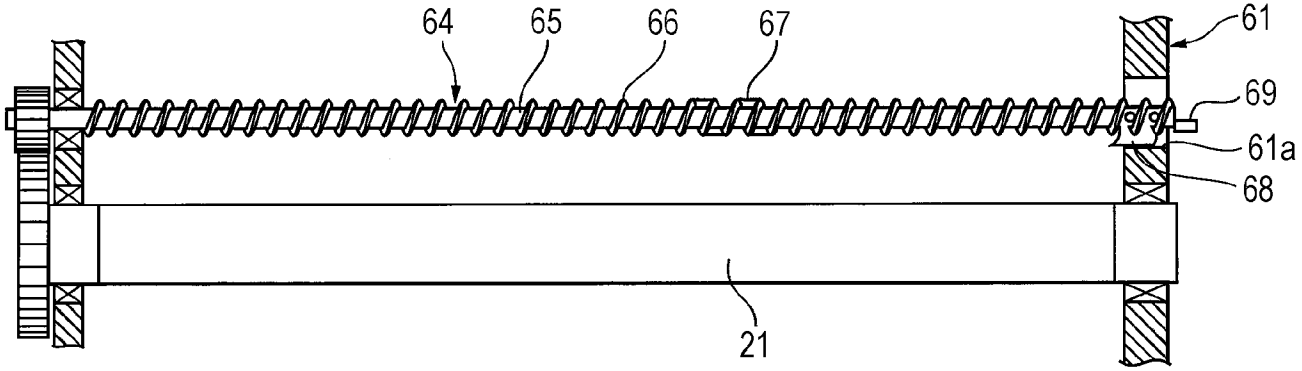
FIG. 5 illustrates a collected-toner-transporting member according to the first exemplary embodiment.

FIG. 5 illustrates the collected-toner-transporting member 64. The collected-toner-transporting member 64 is provided in the cleaning-device container 61 extending parallel to the axial direction of the photoconductor 21. Accordingly, the collected-toner-transporting member 64 also extends parallel to the axial direction of the photoconductor 21. The collected-toner-transporting member 64 includes a rotating shaft 65, a helical blade 66 fixedly provided around the rotating shaft 65, and plural flat blades 67 fixedly provided on the rotating shaft 65. The helical blade 66 rotates with the rotation of the rotating shaft 65 and transports the collected toner that has been scraped off the photoconductor 21 by the scraping member 62 (see FIG. 4) toward the right side in FIG. 5. The flat blades 67 stir the collected toner. The flat blades 67 may be omitted if the stirring function is not necessary.

The rotating shaft 65 of the collected-toner-transporting member 64 is rotated by gears and so forth (not illustrated) in conjunction with the rotation of the photoconductor 21. One end of the rotating shaft 65 extends through a toner discharge port 61*a*, which is provided in the cleaning-device container 61, to the outside of the cleaning-device container 61. A film member 68 is fixed to a portion of the rotating shaft 65 that is near the toner discharge port 61*a*. The film member 68 is in contact with the inner circumferential surface of the toner discharge port 61*a* and rubs the inner circumferential surface of the toner discharge port 61*a* with the rotation of the rotating shaft 65. An eccentric pin 69 is provided at a tip of the rotating shaft 65 that is on the side of the toner discharge port 61*a*. The eccentric pin 69 is attached to a position shifted from the center of the rotating shaft 65.

Figure 6:
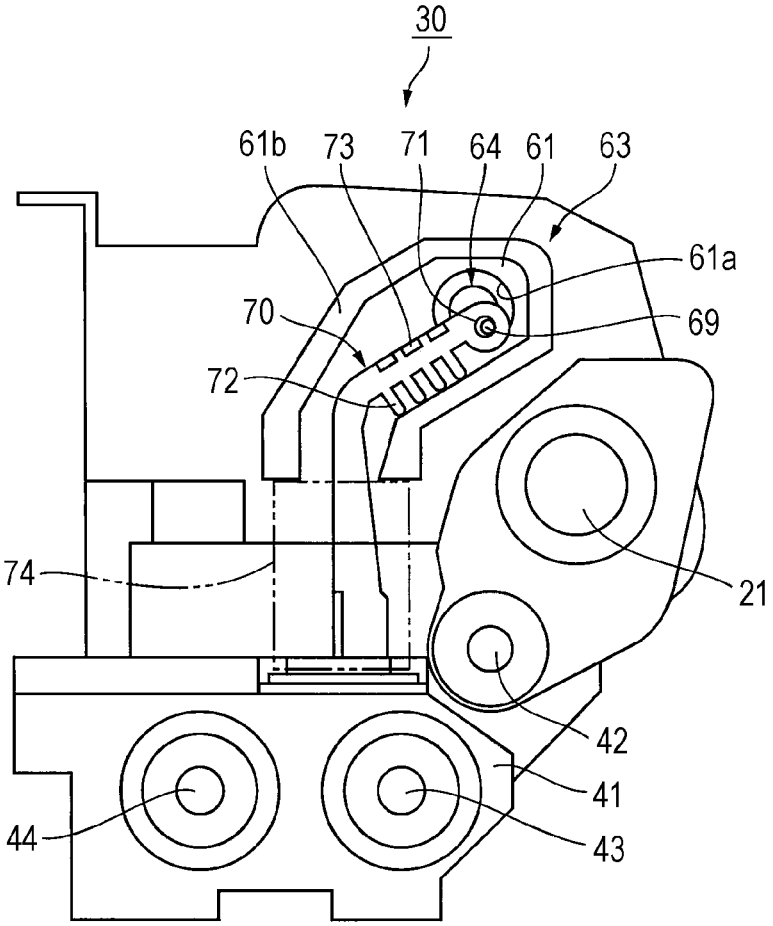
FIG. 6 is a side view of the process unit that is seen from the far side of FIG. 4.

FIG. 6 is a side view of the process unit 30 that is seen from the far side of FIG. 4.

Referring to FIG. 6, the cleaning-device container 61 has a substantially inverted-U-shaped projecting wall 61*b* on an outer wall thereof having the toner discharge port 61*a*. The projecting wall 61*b* projects toward the near side in FIG. 6 and extends toward the lower left side, thereby defining a toner refeeding path. A collected-toner-refeeding member 70 is provided in the toner refeeding path defined by the projecting wall 61*b*. The collected-toner-refeeding member 70 is bent in such a manner as to guide the collected toner downward along the projecting wall 61*b*. The collected-toner-refeeding member 70 has a receiving hole 71 provided in an upper part thereof. The receiving hole 71 receives, with some play, the eccentric pin 69 provided on the rotating shaft 65 of the collected-toner-transporting member 64. The collected-toner-refeeding member 70 extends obliquely downward along the projecting wall 61*b* and is then bent down toward a developing-device housing 41. A portion of the collected-toner-refeeding member 70 that extends along the projecting wall 61*b* has plural comb-tooth-shaped projections 72 that are in contact with the inner surface of the projecting wall 61*b*. The collected-toner-refeeding member 70 also has plural ribs 73 that are provided above the plural projections 72. The ribs 73 increase the strength of the collected-toner-refeeding member 70 and scrape the collected toner adhered to the wall of the toner refeeding path. Needless to say, a lid (not illustrated) is provided over the end facet of the projecting wall 61*b* (the surface of the projecting wall 61*b* on the near side in FIG. 6) and closes the toner refeeding path.

In the first exemplary embodiment, a tubular member 74 (illustrated by a dash-dot-dot line in FIG. 6) is provided between the projecting wall 61*b* and the developing-device housing 41. The tubular member 74 is made of a rubber material, a thin plastic material, or the like and has a substantially rectangular tubular shape with round four corners so that the collected toner is less likely to adhere to the corners.

Thus, the collected-toner-refeeding mechanism 63 according to the first exemplary embodiment allows the collected toner scraped off the photoconductor 21 by the scraping member 62 to be transported by the collected-toner-transporting member 64 and to be fed back into the developing-device housing 41 by the collected-toner-refeeding member 70.

Figure 7:
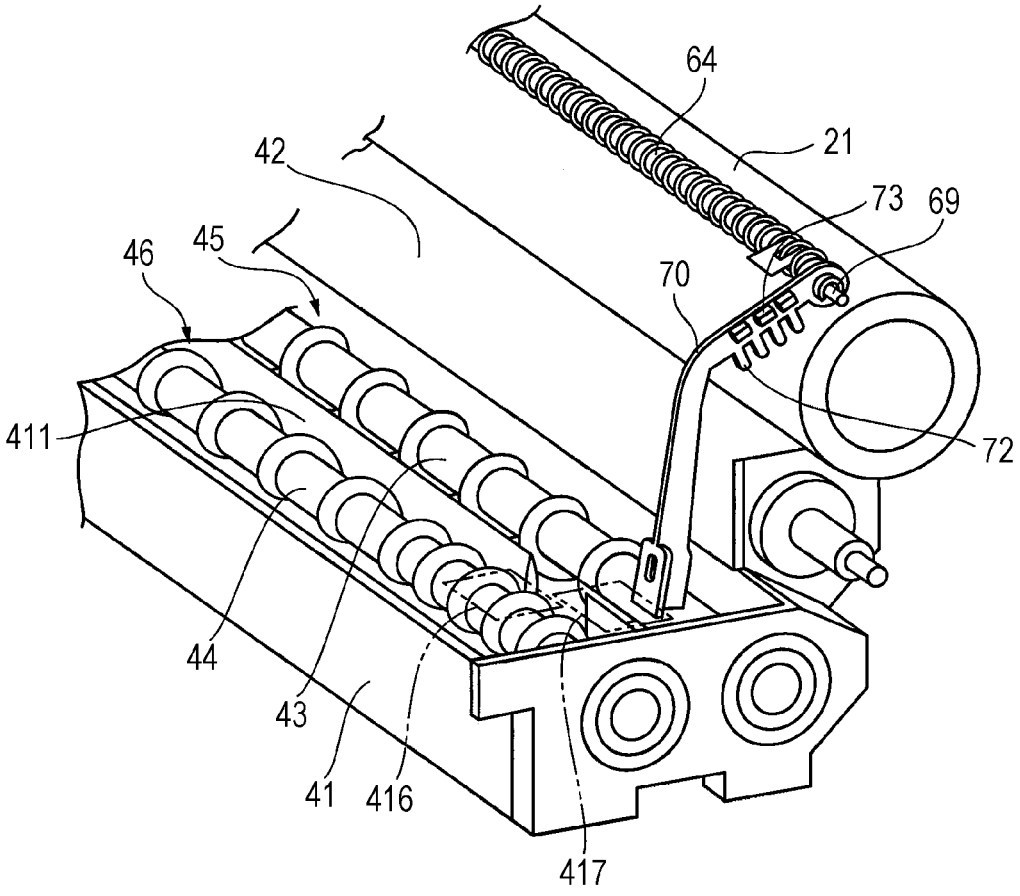
FIG. 7 is a top perspective view of the process unit illustrated in FIG. 6.

FIG. 7 is a perspective view of the process unit 30 illustrated in FIG. 6, with the cleaning-device container 61 and so forth not being illustrated. Referring to FIG. 7, the collected toner is fed back into the developing-device housing 41 from a toner refeeding port 417 (illustrated by a dash-dot-dot line in FIG. 7) by the collected-toner-refeeding mechanism 63. The toner refeeding port 417 is provided between a supply transport path 45 and a stirring transport path 46, which will be described below. The supply transport path 45 is provided nearer to a developing roller 42 than the stirring transport path 46. Fresh toner supplied from the toner supplying unit 16 (see FIG. 3) flows into the developing-device housing 41 from a toner supply port 416.

Configuration of Developing Device

Referring to FIG. 4, the developing device 40 according to the first exemplary embodiment includes the developing-device housing 41 having an opening 41*a* that faces the photoconductor 21, the developing-device housing 41 containing the developer; the developing roller 42 as a developer carrier provided at the opening 41*a* of the developing-device housing 41 and extending parallel to the axial direction of the photoconductor 21, the developing roller 42 being rotatable while carrying the developer; two augers (in the first exemplary embodiment, a supply auger 43 provided nearer to the developing roller 42, and a stirring auger 44 provided farther from the developing roller 42) as stirring-and-transporting members provided in the back of the developing-device housing 41 with respect to the developing roller 42 and extending parallel to the axial direction of the developing roller 42, the augers being configured to stir and transport the developer to be supplied to the developing roller 42; and a developer-thickness-regulating member 47 configured to regulate the thickness of a layer of the developer on the developing roller 42 at a predetermined regulating gap g provided between the developing roller 42 and the developer-thickness-regulating member 47.

The developing-device housing 41 includes a lower case 41*b* and a covering 41*c* as an upper case, with the opening 41*a* provided at the boundary between the two. The developing roller 42, the two augers 43 and 44, the developer-thickness-regulating member 47, and so forth are housed in the lower case 41*b*.

The developing roller 42 includes a fixed magnetic body 42*a* and a developing sleeve 42*b* rotatably provided around the magnetic body 42*a*. Plural magnetic poles MP1 to MP5 are provided in the magnetic body 42*a*. The two augers 43 and 44 each include a rotating shaft and a helical blade provided around the rotating shaft. With the rotation of the rotating shaft, each of the augers 43 and 44 stirs and transports the developer in the axial direction thereof. The plural magnetic poles MP1 to MP5 include, for example, a pickup magnetic pole MP1 for picking up and attracting the developer to the developing roller 42, a developer-thickness-regulating magnetic pole MP2 for regulating the thickness of a developer layer formed between the developing roller 42 and the developer-thickness-regulating member 47, a development magnetic pole MP3 provided in a development area between the developing roller 42 and the photoconductor 21, a transport magnetic pole MP4 for transporting the developer, and a release magnetic pole MP5 for releasing the developer from the developing roller 42. The number and arrangement of magnetic poles may be determined according to need.

The two augers 43 and 44 are provided in two respective developer transporting paths, namely, the supply transport path 45 provided nearer to the developing roller 42, and the stirring transport path 46. The two transport paths 45 and 46 are separated from each other by a partition 411 provided by a part of the lower case 41*b*. The partition 411 has openings (not illustrated) at two respective longitudinal-direction ends thereof. The openings allow the supply transport path 45 and the stirring transport path 46 to communicate with each other. Rotation of the two augers 43 and 44 causes the developer to circulate between the supply transport path 45 and the stirring transport path 46.

The developer-thickness-regulating member 47 is a long or substantially long magnetic member having a circular or substantially circular sectional shape and extending parallel to the axial direction of the developing roller 42. The developer-thickness-regulating member 47 faces the developing roller 42 at a position on the downstream side with respect to the supply auger 43 but on the upstream side with respect to the opening 41*a* in the direction of rotation of the developing roller 42, with the regulating gap g being interposed between the developing roller 42 and the developer-thickness-regulating member 47. The developer-thickness-regulating member 47 according to the first exemplary embodiment is made of, for example, magnetic-nickel-plated brass and has a diameter $\phi$ of 6 mm. The material of the developer-thickness-regulating member 47 is not limited to magnetic-nickel-plated brass and may be any other known magnetic material. The diameter $\phi$ of the developer-thickness-regulating member 47 is about 5 mm to 10 mm, typically.

The developer-thickness-regulating member 47 configured as described above is attached to the developing-device housing 41 as follows. In FIG. 4, only first sealing members 48 and 49 that hold the developer-thickness-regulating member 47 therebetween from above and below, respectively, are illustrated.

Figure 8:
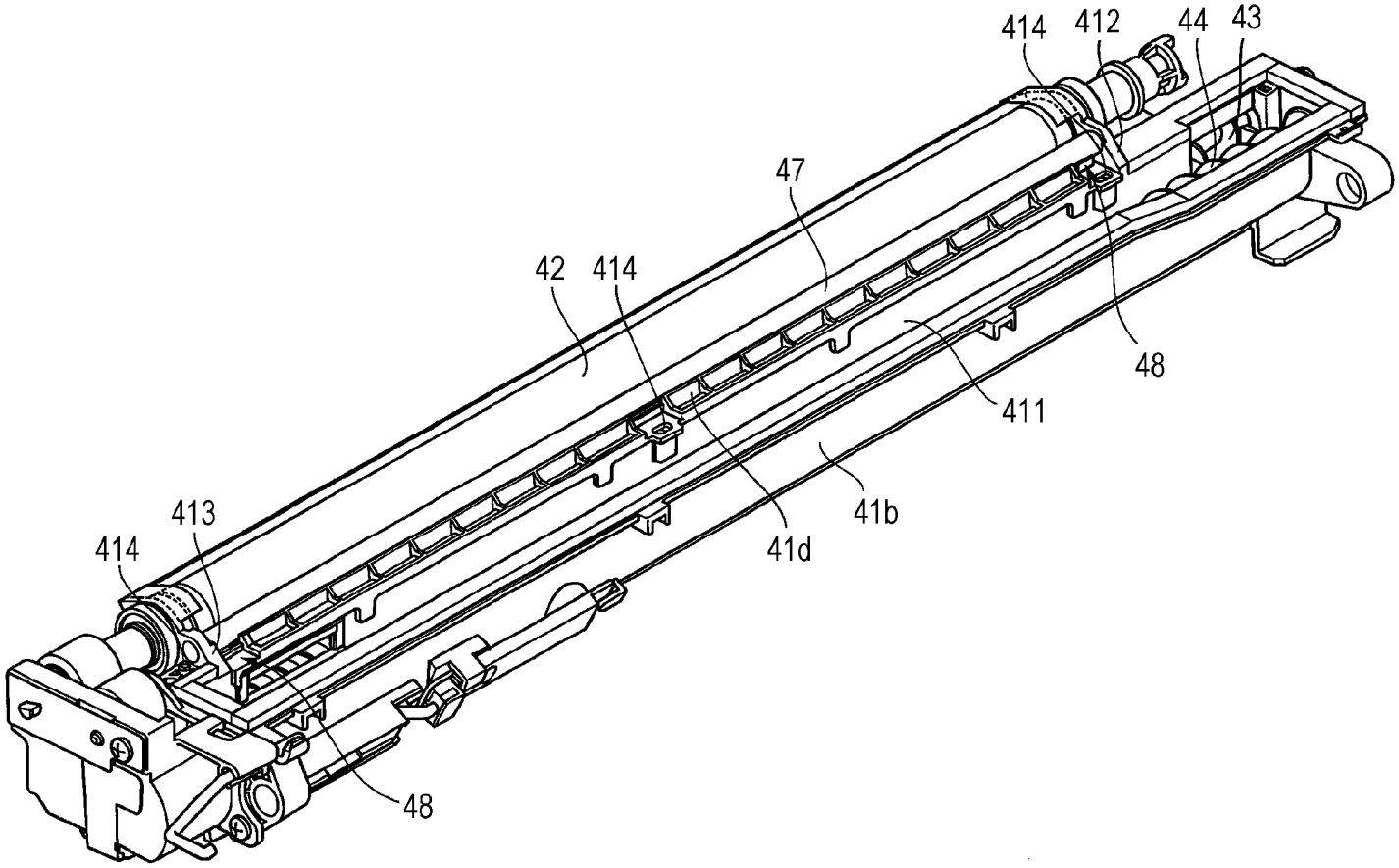
FIG. 8 is a perspective view illustrating the developer-thickness-regulating member and other associated elements that are provided in a lower case of the process unit according to the first exemplary embodiment.
Figure 9:
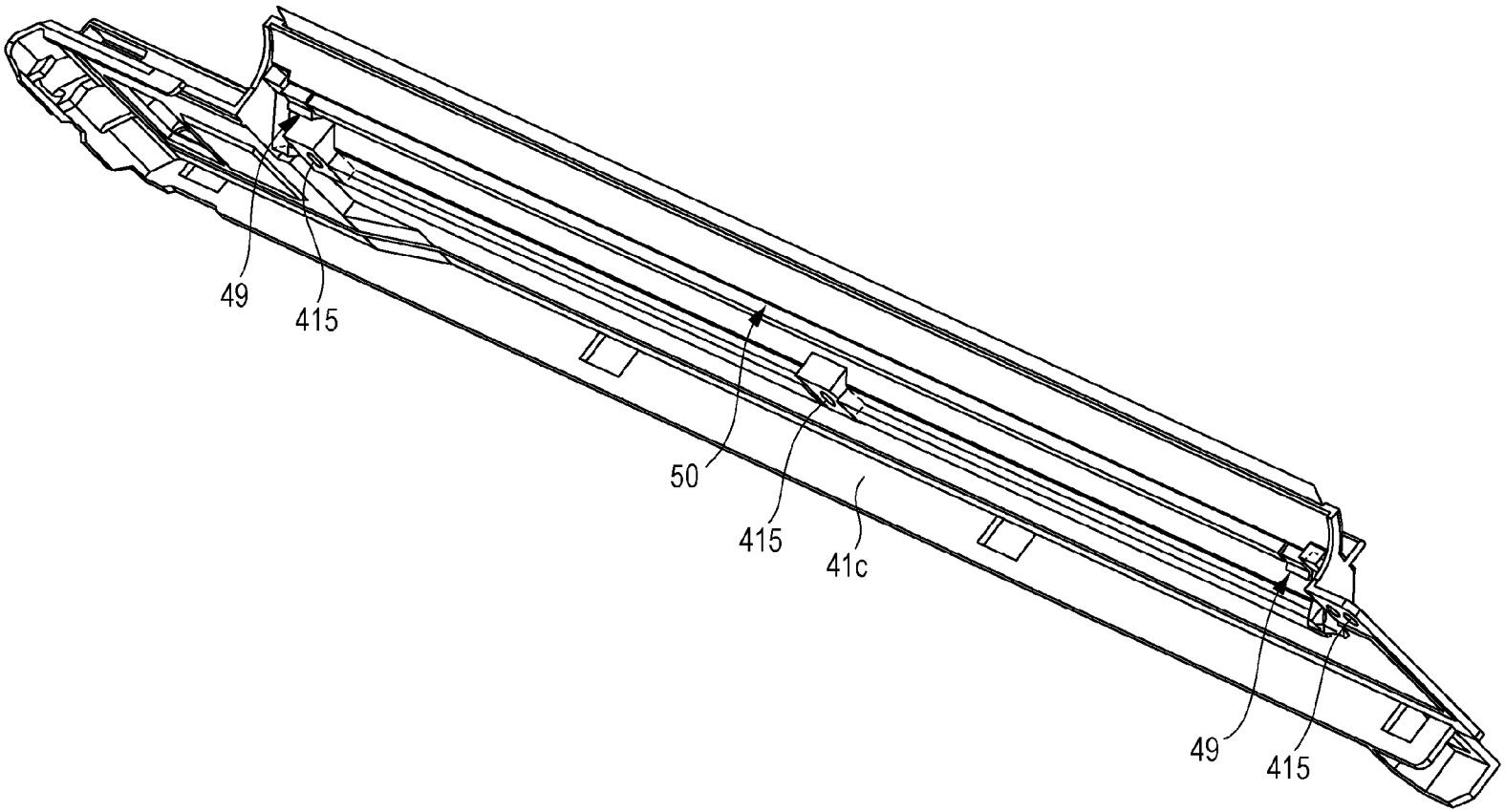
FIG. 9 is a perspective view illustrating a covering, as an upper case, and other associated elements included in the process unit according to the first exemplary embodiment.
Figure 10:
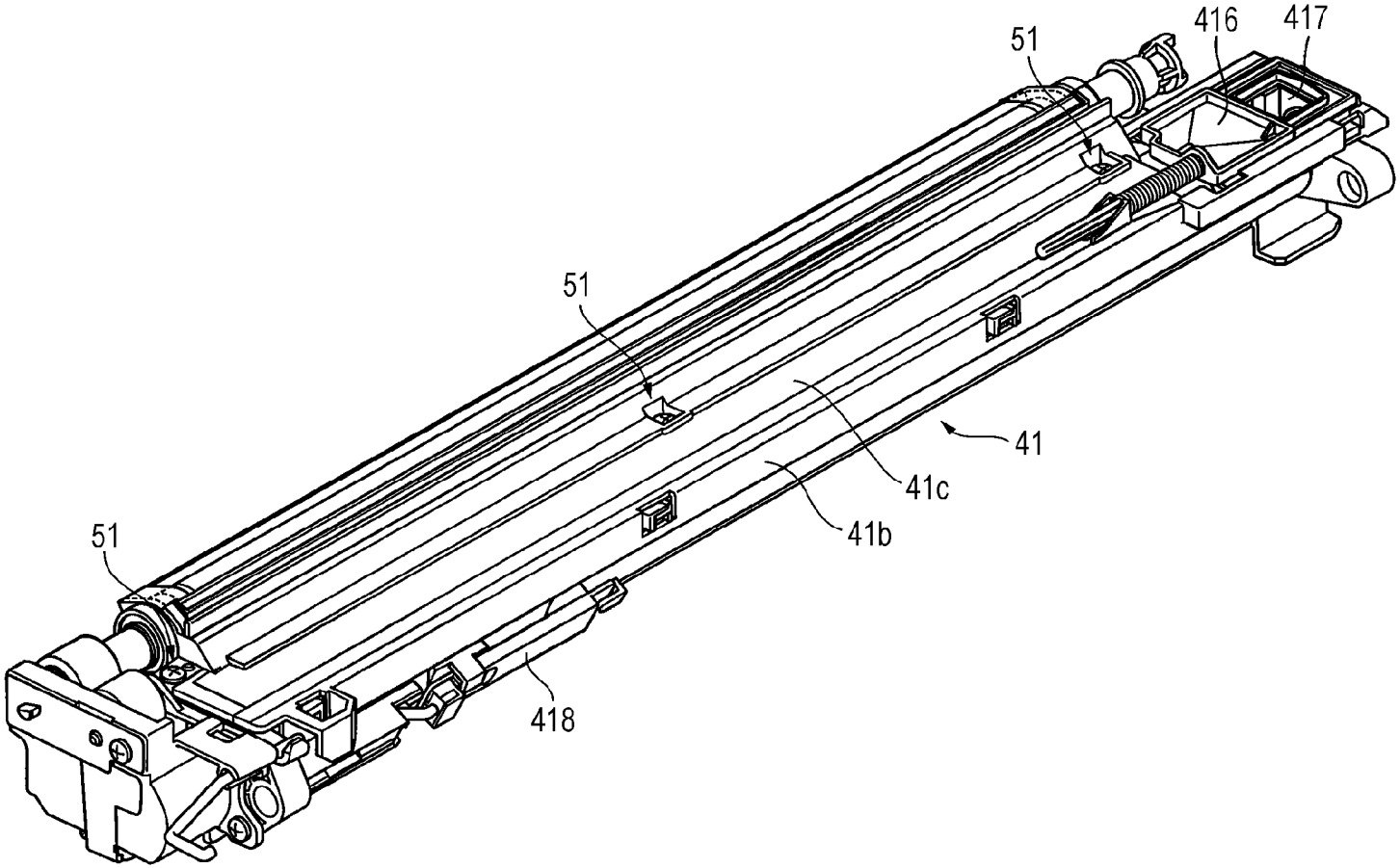
FIG. 10 is a perspective view of the process unit according to the first exemplary embodiment, with the covering as the upper case provided over the lower case.

FIGS. 8 to 10 are perspective views illustrating how the developer-thickness-regulating member 47 is attached to the developing-device housing 41. Referring to FIG. 8, the lower case 41*b* is provided with an inner frame 41*d* extending from the partition 411 over the supply transport path 45 provided with the supply auger 43. The inner frame 41*d* is provided at two ends thereof in the axial direction of the developing roller 42 with brackets 412 and 413, respectively, projecting upward therefrom. The developing roller 42 is rotatably supported by the brackets 412 and 413. The developer-thickness-regulating member 47 is also supported by the brackets 412 and 413. The two longitudinal-direction ends of the developer-thickness-regulating member 47 are fitted in the respective brackets 412 and 413 on the inner frame 41*d* with some play. Therefore, the developer-thickness-regulating member 47 alone is not tightly fixed. The inner frame 41*d* has three through holes 414. The lower case 41*b* has three screw holes provided in correspondence with the through holes 414, respectively.

Case-side sealing members 48 as first sealing members are provided at respective positions of the inner frame 41*d* that face the respective longitudinal-direction ends of the developer-thickness-regulating member 47. The case-side sealing members 48 prevent the developer-thickness-regulating member 47 from rotating and are fixed to the inner frame 41*d* by bonding or the like. The developer-thickness-regulating member 47 is attached to the developing-device housing 41 in such a manner as to press the case-side sealing members 48.

FIG. 9 is a bottom perspective view of the covering 41*c* seen from the side of the developing roller 42. Referring to FIG. 9, covering-side sealing members 49 as first sealing members are provided at respective positions of the covering 41*c* that face the two respective ends of the developer-thickness-regulating member 47. The covering-side sealing members 49 prevent the developer-thickness-regulating member 47 from rotating and are fixed to the covering 41*c* by bonding or the like. Furthermore, a second sealing member 50 that stops the flow of the developer extends over a space between the covering-side sealing members 49 and is fixed to the covering 41*c* by bonding or the like. Furthermore, the covering 41*c* has through holes 415 provided at positions thereof corresponding to the three respective through holes 414 provided in the inner frame 41*d*.

The above elements are assembled into the developing-device housing 41 illustrated in FIG. 10. Referring to FIG. 10, the lower case 41*b*, the covering 41*c*, and the inner frame 41*d* are assembled and fastened together at three positions with screws 51, respectively. Thus, as illustrated in FIGS. 4 and 8 to 10, the two ends of the developer-thickness-regulating member 47 are each pressed between a corresponding one of the case-side sealing members 48 and a corresponding one of the covering-side sealing members 49, whereby the developer-thickness-regulating member 47 is prevented from rotating when the developer passes through the regulating gap g. Furthermore, the two kinds of first sealing members 48 and 49 and the second sealing member 50 prevent the developer from passing through any positions other than the regulating gap g and from spreading over a portion of the developing roller 42 that has undergone developer-thickness regulation. To prevent the leakage of the developer from the connection between the second sealing member 50 and each of the covering-side sealing members 49, the two sealing members 50 and 49 have, for example, respective jagged edges extending in the circumferential direction of the developer-thickness-regulating member 47 and being in mesh with each other so that a long creepage distance between the two is provided. The toner concentration of the developer in the stirring transport path 46 is detected by a concentration detector 418.

As described above, in the first exemplary embodiment, the two ends of the developer-thickness-regulating member 47 are each held between a corresponding one of the case-side sealing members 48 and a corresponding one of the covering-side sealing members 49 that serve as the first sealing members, and the second sealing member 50 extends over the space between the covering-side sealing members 49. The case-side sealing members 48, the covering-side sealing members 49, and the second sealing member 50 are all positioned on a virtual center line of the developer-thickness-regulating member 47 that extends parallel to the tangent to the developing roller 42 in the regulating gap g.

The first sealing members (the case-side sealing members 48 and the covering-side sealing members 49) according to the first exemplary embodiment are all made of the same material such as urethane rubber. According to a measurement of the compression rate of the material of the first sealing members in which samples each having a size of 100 mm×100 mm with a thickness of 12 mm or larger are each subjected to a predetermined compressive load, the range of compressive load (compressive force) required for obtaining a predetermined compression rate (for example, 25%) is 0.04 $N/mm^2$ to 0.1 $N/mm^2$. The second sealing member 50 is also made of a material such as urethane rubber. According to the same measurement conducted on the material of the second sealing member 50 under the same conditions as above, the range of the required compressive load (compressive force) is 0.002 $N/mm^2$ to 0.003 $N/mm^2$. In a state where the case-side sealing members 48, the covering-side sealing members 49, and the second sealing member 50 are set in the developing-device housing 41, the compression rate of each of the two kinds of first sealing members 48 and 49 is 40% to 60%, and the compression rate of the second sealing member 50 is 25% to 50%.

Operation of Image Forming Apparatus

Referring to FIG. 3, an operation performed by the image forming apparatus 10 according to the first exemplary embodiment will now be described.

Referring to FIG. 3, a toner image formed on the photoconductor 21 of the process unit 30 is transferred by the transfer device 25 to a recording material P supplied from the recording-material-supplying unit 12. The toner image on the recording material P is fixed to the recording material P by the fixing device 14. The recording material P having the fixed toner image is discharged by the pair of discharge rollers 15 onto the recording-material-receiving portion 13.

Operation of Developing Device

An operation performed by the developing device 40 in the above image forming operation will now be described with reference to FIGS. 4 and 8 to 10.

The developer is stirred and transported by the stirring auger 44 provided in the stirring transport path 46, thereby being frictionally electrified. The frictionally electrified developer is guided to the supply transport path 45 and is supplied to the developing roller 42 by the supply auger 43. Thus, the developer circulates between the supply transport path 45 and the stirring transport path 46 with the rotation of the supply auger 43 and the stirring auger 44. Meanwhile, the concentration detector 418 detects the toner concentration of the developer in the stirring transport path 46. If the toner concentration is below a preset level, fresh toner is supplied, according to need, from the toner supplying unit 16 (see FIG. 3) into the toner supply port 416. The fresh toner thus supplied is mixed with the existing toner in the stirring transport path 46, and the mixture is transported toward the concentration detector 418. Therefore, the fresh toner is substantially evenly distributed in the developer at the concentration detector 418. Accordingly, the concentration detector 418 detects an average toner concentration. The developer in which the toner is substantially evenly distributed is then supplied from the supply transport path 45 toward the developing roller 42.

The pickup magnetic pole MP1 in the magnetic body 42*a* of the developing roller 42 attracts the developer to the developing roller 42 (specifically, to the developing sleeve 42*b*). With the rotation of the developing roller 42, the developer carried by the developing roller 42 is transported to a position where the developing roller 42 faces the developer-thickness-regulating member 47. At the position where the developing roller 42 faces the developer-thickness-regulating member 47, a satisfactory amount of bristles of the developer are formed by the magnetism produced between the developer-thickness-regulating magnetic pole MP2 in the magnetic body 42*a* and the developer-thickness-regulating member 47 that is magnetic.

Figure 11A:
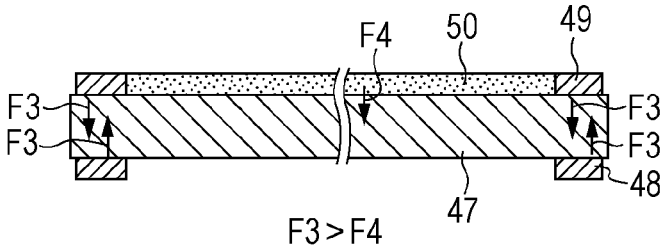
FIG. 11A illustrates an arrangement of first and second sealing members according to the first exemplary embodiment.

In the above state, the first sealing members (the case-side sealing members 48 and the covering-side sealing members 49) provided at the two longitudinal-direction ends of the developer-thickness-regulating member 47 prevent the rotation of the developer-thickness-regulating member 47 even though the developer is flowing. FIG. 11A illustrates the relationship among the developer-thickness-regulating member 47, the first sealing members (the case-side sealing members 48 and the covering-side sealing members 49), and the second sealing member 50 according to the first exemplary embodiment. Letting the contact pressure applied by each of the first sealing members 48 and 49 to the developer-thickness-regulating member 47 be F3 and the contact pressure applied by the second sealing member 50 to the developer-thickness-regulating member 47 be F4, a relationship of F3>F4 holds in the first exemplary embodiment. That is, reducing the contact pressure applied by the second sealing member 50 to the developer-thickness-regulating member 47 allows the developer-thickness-regulating member 47 in a bent state to restore its original shape with the flow of the developer, stabilizing the regulating gap g as illustrated in FIG. 2A.

Figure 12:
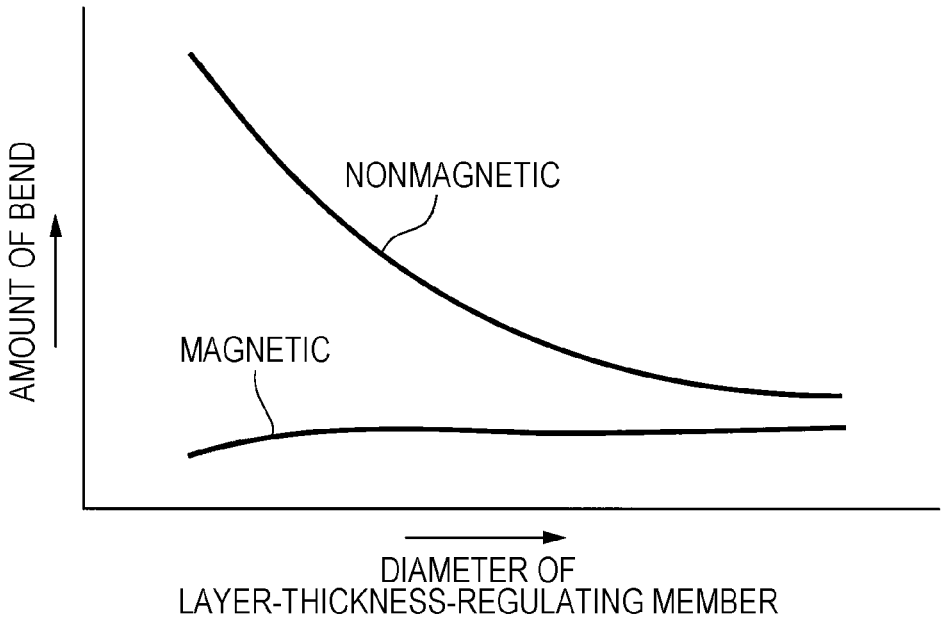
FIG. 12 is a graph illustrating the relationship between the diameter of the developer-thickness-regulating member and the amount of bend in the developer-thickness-regulating member that occurs when the thickness of a layer of the developer is regulated in each of a case of a magnetic developer-thickness-regulating member and a case of a nonmagnetic developer-thickness-regulating member.

As a result of examination on the change in the amount of bend in the developer-thickness-regulating member 47 that occurs when the developer is transported to the developer-thickness-regulating member 47, it has been found that the change in the amount of bend varies with the diameter and the material (magnetic or nonmagnetic) of the developer-thickness-regulating member 47, as graphed in FIG. 12.

The graph illustrated in FIG. 12 shows that as the diameter of the developer-thickness-regulating member 47 is increased gradually, the amount of bend increases only slightly when the developer-thickness-regulating member 47 is made of a magnetic material but sharply decreases when the developer-thickness-regulating member 47 is made of a nonmagnetic material. When the developer-thickness-regulating member 47 is made of a magnetic material, it is assumed that as the diameter of the developer-thickness-regulating member 47 increases, the magnetism produced between the developer-thickness-regulating member 47 and the developing roller 42 is enhanced correspondingly, reducing the apparent effect of the pressure applied to the developer-thickness-regulating member 47 by the developer. In contrast, when the developer-thickness-regulating member 47 is made of a nonmagnetic material, it is assumed that the amount of bend in the developer-thickness-regulating member 47 decreases because the rigidity of the developer-thickness-regulating member 47 itself increases with the increase in the diameter thereof.

What is to be noted here is the change in the amount of bend that occurs with the decrease in the diameter of the developer-thickness-regulating member 47. When the developer-thickness-regulating member 47 is made of a magnetic material, not only the change in the amount of bend but also the amount of bend itself tends to be small. In contrast, when the developer-thickness-regulating member 47 is made of a nonmagnetic material, the amount of bend becomes extremely large. This means that employing a magnetic developer-thickness-regulating member 47 allows the developer-thickness-regulating member 47 to be made thinner and to be designed within a wide range of diameter, which demonstrates the effectiveness of the first exemplary embodiment.

In the first exemplary embodiment, the developer-thickness-regulating member 47 has a diameter ϕ of about 5 mm to 10 mm. In terms of maintaining the rigidity of the developer-thickness-regulating member 47, the diameter ϕ may be 5 mm or larger. A diameter ϕ of over 10 mm may lead to a cost increase.

In the first exemplary embodiment employing a magnetic developer-thickness-regulating member 47, the size of the regulating gap g between the developing roller 42 and the developer-thickness-regulating member 47 is maintained to be substantially uniform by the pressure generated by the flow of the developer (the developer pressure). Accordingly, the thickness of the layer of the developer formed on the developing roller 42 as a result of developer-thickness regulation is maintained to be substantially uniform. Meanwhile, the developer that is not allowed to pass through the regulating gap g is prevented from flowing over a portion of the developing roller 42 that is on the downstream with respect to the developer-thickness-regulating member 47 by the two kinds of first sealing members 48 and 49 and the second sealing member 50. Thus, the formation of the layer of the developer through developer-thickness regulation is stabilized.

When the layer of the developer formed on the developing roller 42 through developer-thickness regulation as described above reaches the development area where the developing roller 42 faces the photoconductor 21, particles of the toner included in the developer fly toward the photoconductor 21 by the effect of the development magnetic pole MP3 provided in the magnetic body 42*a* of the developing roller 42 and the effect of an electric field produced between the photoconductor 21 and the developing roller 42. Thus, the electrostatic latent image on the photoconductor 21 is developed into a toner image with the toner. The developer on the developing roller 42 that has passed through the development area is released from the developing roller 42 by, for example, the effect of two magnetic poles of the same polarity that are adjacent to each other in the magnetic body 42*a* (in the first exemplary embodiment, the transport magnetic pole MP4 and the release magnetic pole MP5). The developer thus released from the developing roller 42 is fed back into the supply transport path 45 and then to the stirring transport path 46, and is reused for another development process.

Operation of Collected-Toner-Refeeding Mechanism

An operation performed by the collected-toner-refeeding mechanism 63 that refeeds toner collected from the photoconductor 21 in the developing device 40 will now be described with reference to FIGS. 4 to 7.

Residual toner on the photoconductor 21 is scraped by the scraping member 62 and is collected in the cleaning-device container 61. When the collected-toner-transporting member 64 is rotated, the helical blade 66 rotates and transports the collected toner in the cleaning-device container 61 toward the toner discharge port 61*a*. Then, the toner is discharged from the toner discharge port 61*a* toward the projecting wall 61*b*. Meanwhile, with the rotation of the collected-toner-transporting member 64, the eccentric pin 69 circles. With a large circular movement of the eccentric pin 69, the collected-toner-refeeding member 70 moves back and forth on the inner side of the projecting wall 61*b*. With the back-and-forth movement of the collected-toner-refeeding member 70, elements such as the plural comb-tooth-shaped projections 72 and the ribs 73 guide the collected toner discharged to the inner side of the projecting wall 61*b* toward the lower side. The collected toner thus guided downward by the collected-toner-refeeding member 70 is fed back into the developing-device housing 41 from the toner refeeding port 417 to a position between the supply transport path 45 and the stirring transport path 46 and near the projecting wall 61*b*.

The collected toner thus fed back into the developing-device housing 41 is immediately guided toward the stirring transport path 46 and is transported toward the concentration detector 418 while being stirred in the stirring transport path 46 by the stirring auger 44. Therefore, the concentration detector 418 detects the toner concentration of the developer that has been fully stirred in the stirring transport path 46. Thus, the collected toner is distributed over the entirety of the developer, and the developer having an even distribution of toner is transported toward the supply transport path 45 provided with the supply auger 43 and is used for another development process.

Particles of the toner collected from the photoconductor 21 as described above are more likely to flocculate, in general, than particles of fresh toner (in the first exemplary embodiment, the toner supplied from the toner supplying unit 16). Therefore, a developer containing such collected toner tends to have a larger particle size than a developer containing fresh toner. If the regulating gap g is too narrow for a developer having a large particle size, the developer-thickness regulation may be implemented inappropriately. Specifically, part of the regulating gap g may be clogged with the developer, leading to a problem such as a nonuniform thickness of the layer of the developer that has undergone developer-thickness regulation. Consequently, the quality of the resulting image may be deteriorated with nonuniformity, white lines, and so forth. However, since the developer-thickness-regulating member 47 according to the first exemplary embodiment is made of a magnetic material, the regulating gap g is allowed to be made wide enough to effectively implement developer-thickness regulation even if flocculation of toner particles occurs.

Figure 11B:
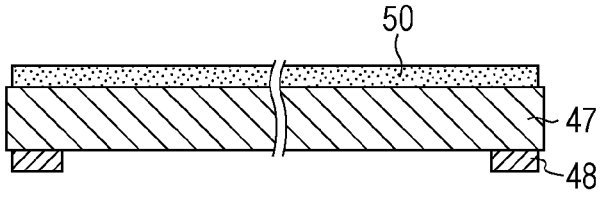
FIG. 11B illustrates an arrangement of first and second sealing members according to a modification of the first exemplary embodiment.
Figure 11C:
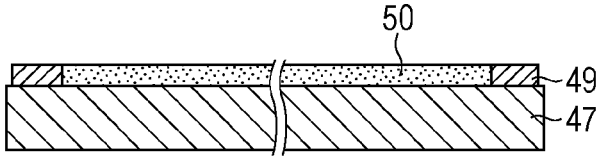
FIG. 11C illustrates an arrangement of first and second sealing members another modification of the first exemplary embodiment.

In the first exemplary embodiment, the first sealing members 48 and 49 and the second sealing member 50 are provided to the developer-thickness-regulating member 47 as illustrated in FIG. 11A. Other arrangements such as those illustrated in FIGS. 11B and 11C are also acceptable. FIG. 11B illustrates an exemplary arrangement in which the first sealing members 48 (only the case-side sealing members 48) are provided on one side (the lower side in FIG. 11B) of the developer-thickness-regulating member 47, and the second sealing member 50 extends over the entirety of the developer-thickness-regulating member 47. FIG. 11C illustrates another exemplary arrangement in which the first sealing members 49 (only the covering-side sealing members 49) are provided on one side (the upper side in FIG. 11C) of the developer-thickness-regulating member 47, and the second sealing member 50 extends over a space between the first sealing members 49. In any of the above arrangements, the developer-thickness-regulating member 47 only needs to be prevented from rotating by the first sealing members 48 or 49.

The first exemplary embodiment concerns a case where residual toner on the photoconductor 21 is collected and is reused as the developer by employing the collected-toner-refeeding mechanism 63. Needless to say, the magnetic developer-thickness-regulating member 47 may be employed in a developing device that does not include the collected-toner-refeeding mechanism 63.

The first exemplary embodiment concerns a case where the first sealing members 48 and 49 and the second sealing member 50 are all positioned on a virtual center line of the developer-thickness-regulating member 47 that extends parallel to the tangent to the developing roller 42 in the regulating gap g (the first sealing members 48 and 49 and the second sealing member 50 are aligned in a direction orthogonal to the regulating gap g). Alternatively, the first sealing members 48 and 49 and the second sealing member 50 may be provided at positions slightly shifted from the virtual center line of the developer-thickness-regulating member 47 that extends parallel to the tangent to the developing roller 42 in the regulating gap g, as long as the first sealing members 48 and 49 and the second sealing member 50 do not hinder the attraction of the developer-thickness-regulating member 47 toward the developing roller 42 while sealing gaps that may allow the developer to flow therethrough to any unintended areas.

Second Exemplary Embodiment

Figure 13:
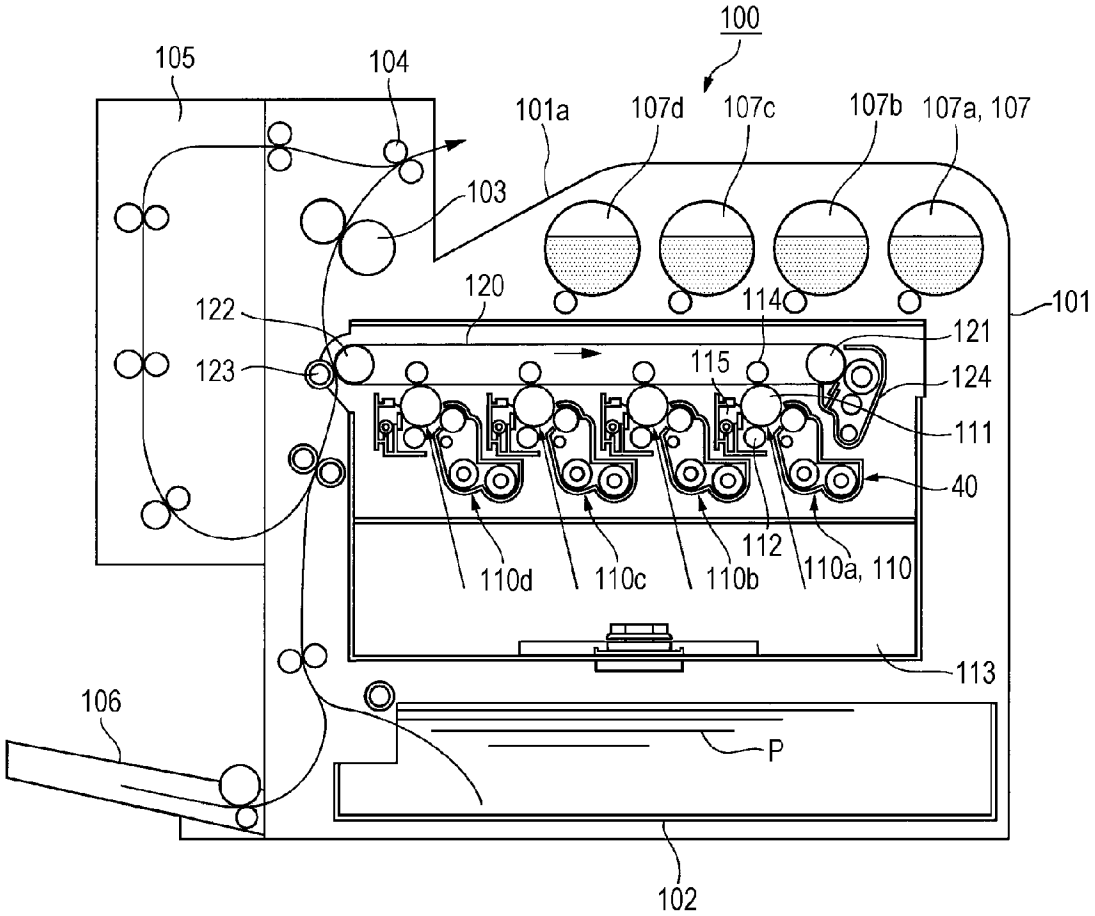
FIG. 13 illustrates an overall configuration of an image forming apparatus according to a second exemplary embodiment of the present invention.

FIG. 13 schematically illustrates an image forming apparatus 100 according to a second exemplary embodiment of the present invention.

Referring to FIG. 13, the image forming apparatus 100 according to the second exemplary embodiment includes an apparatus housing 101, in which image forming units 110 (110*a* to 110*d*) for four respective colors (for example, black, yellow, magenta, and cyan) are aligned in the horizontal direction, an intermediate transfer belt 120 that rotates in the direction in which the image forming units 110 are aligned is provided above the image forming units 110, and a recording-material-supplying unit 102 that contains recording materials P is provided in a lower part of the apparatus housing 101. The recording materials P are transported one by one in a substantially vertical direction from the recording-material-supplying unit 102.

In the second exemplary embodiment, the image forming units 110 (110*a* to 110*d*) all have substantially the same configuration. Therefore, the image forming unit 110*a* will be described herein as a representative. The image forming unit 110*a* includes a photoconductor 111 on which a toner image is to be formed, a charging device 112 that charges the photoconductor 111 to a predetermined potential, an exposure device 113 (in the second exemplary embodiment, one exposure device 113 is shared among the four image forming units 110*a* to 110*d*) that draws an electrostatic latent image on the photoconductor 111 charged by the charging device 112, a developing device 40 that develops the electrostatic latent image on the photoconductor 111 into a toner image with toner, a first transfer device 114 provided across the intermediate transfer belt 120 from the photoconductor 111 and that transfers the toner image on the photoconductor 111 to the intermediate transfer belt 120 for first transfer, and a cleaning device 115 that removes residual toner from the photoconductor 111 after the first transfer.

The intermediate transfer belt 120 according to the second exemplary embodiment is stretched between two stretching rollers 121 and 122 and is rotatable in a direction of the arrow illustrated in FIG. 13 with, for example, the stretching roller 121 serving as a driving roller. A second transfer device 123 that collectively transfers the toner images on the intermediate transfer belt 120 to the recording material P for second transfer is provided across the intermediate transfer belt 120 from the stretching roller 122. A belt cleaning device 124 that cleans the intermediate transfer belt 120 that has undergone the second transfer performed by the second transfer device 123 is provided across the intermediate transfer belt 120 from the stretching roller 121.

A fixing device 103 that fixes the toner images on the recording material P to the recording material P is provided above the second transfer device 123 in the apparatus housing 101. A pair of discharge rollers 104 that discharges the recording material P having undergone the fixing onto a recording-material-receiving portion 101*a* is provided in an upper part of the apparatus housing 101. The apparatus housing 101 according to the second exemplary embodiment is provided on the left side thereof with a reversing unit 105 that reverses the recording material P and transports the reversed recording material P so that images are formed on both sides of the recording material P. The apparatus housing 101 is also provided with a manual feeding mechanism 106 that allows a recording material P to be fed manually. The image forming apparatus 100 also includes toner supplying units 107 (107*a* to 107*d*) that each supply toner to a corresponding one of the developing devices 40 for the respective colors.

Figure 14:
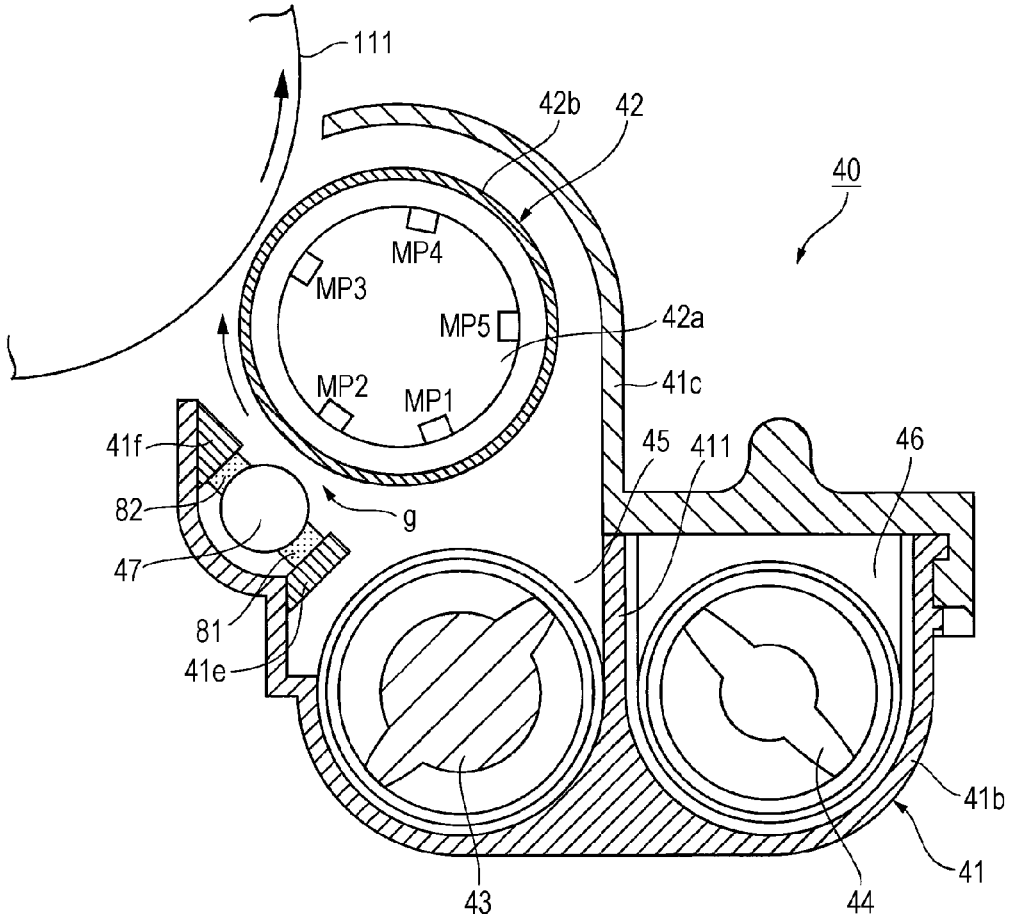
FIG. 14 schematically illustrates a developing device according to the second exemplary embodiment.

Now, the developing device 40 according to the second exemplary embodiment will be described. FIG. 14 schematically illustrates the developing device 40 according to the second exemplary embodiment. The developing device 40 according to the second exemplary embodiment differs from the developing device 40 according to the first exemplary embodiment (see FIG. 4) in the position of the developer-thickness-regulating member 47. Elements that are the same as those described in the first exemplary embodiment are denoted by corresponding ones of the reference numerals used in the first exemplary embodiment, and description of such elements is omitted.

Referring to FIG. 14, the developer-thickness-regulating member 47 is provided below the developing roller 42. The developer-thickness-regulating member 47 is a long or substantially long magnetic member having a circular or substantially circular sectional shape, as in the first exemplary embodiment. Two longitudinal-direction ends of the developer-thickness-regulating member 47 are each held between two first sealing members 81 and 82 (both are fixed to the lower case 41*b* and are hereinafter denoted as a lower sealing member 81 and an upper sealing member 82). Furthermore, the developer-thickness-regulating member 47 is provided with a second sealing member (not illustrated) extending over a space between the upper sealing members 82 provided at the two respective longitudinal-direction ends thereof. Brackets 41*e* and 41*f* project from respective positions of the developing-device housing 41 that are near the developer-thickness-regulating member 47. The brackets 41*e* and 41*f* are fixed to the developing-device housing 41. The lower sealing members 81 are fixed to the respective brackets 41*e* by bonding or the like. The upper sealing members 82 are fixed to the respective brackets 41*f* by bonding or the like. The developing device 40 according to the second exemplary embodiment includes no collected-toner-refeeding mechanism that collects residual toner from the photoconductor 111 and refeeds the toner into the developing-device housing 41 for reuse.

The image forming apparatus 100 configured as described above operates as follows.

Referring to FIG. 13, toner images in the respective colors that are formed on the respective photoconductors 111 by the respective image forming units 110 (110*a* to 110*d*) are sequentially transferred to the intermediate transfer belt 120 for the first transfer in such a manner as to be superposed one on top of another. The superposed toner images are collectively transferred by the second transfer device 123 from the intermediate transfer belt 120 to a recording material P supplied to the second transfer device 123 from the recording-material-supplying unit 102. The recording material P having the toner images collectively transferred thereto is subjected to a fixing process performed by the fixing device 103, and is discharged by the pair of discharge rollers 104 onto the recording-material-receiving portion 101*a*.

The developing device 40 according to the second exemplary embodiment operates in substantially the same manner as in the first exemplary embodiment.

The developer is stirred and transported by the stirring auger 44 and the supply auger 43 and thus circulates between the stirring transport path 46 and the supply transport path 45. The developer that has been fully electrified is supplied from the supply auger 43 to the developing roller 42 by the effect of the pickup magnetic pole MP1 provided in the magnetic body 42*a* of the developing roller 42. The developer thus supplied to the developing roller 42 passes through the regulating gap g provided between the developing roller 42 and the developer-thickness-regulating member 47, whereby the thickness of a layer of the developer is regulated by the effect of the developer-thickness-regulating magnetic pole MP2 provided in the magnetic body 42*a*. The layer of the developer having the regulated thickness on the developing roller 42 is subjected to a magnetic field and an electric field produced by the development magnetic pole MP3 in the development area where the developing roller 42 faces the photoconductor 111, whereby particles of the toner included in the developer fly toward the photoconductor 111 and develop the electrostatic latent image on the photoconductor 111 into a toner image. The developer remaining on the developing roller 42 after the development is released from the developing roller 42 by, for example, the effect of two magnetic poles of the same polarity that are adjacent to each other in the magnetic body 42*a* (in the second exemplary embodiment, the transport magnetic pole MP4 and the release magnetic pole MP5). The developer thus released from the developing roller 42 is fed back into the supply transport path 45 and then to the stirring transport path 46, and is reused for another development process.

In the developing device 40 that operates as described above, a satisfactory amount of bristles of the developer are formed by the magnetism produced between the developer-thickness-regulating magnetic pole MP2 provided in the magnetic body 42*a* of the developing roller 42 and the developer-thickness-regulating member 47 that is magnetic. Therefore, a wide and stabilized regulating gap g is provided. Furthermore, since the lower sealing members 81 and the upper sealing members 82 as the first sealing members prevent the developer-thickness-regulating member 47 from rotating, the occurrence of nonuniformity in the developer on the developing roller 42 is suppressed. Consequently, the occurrence of nonuniformity or white lines in the resulting image obtained on the recording material P is suppressed.

The developing device 40 according to the second exemplary embodiment may include the collected-toner-refeeding mechanism 63 that refeeds collected toner as with the developing device 40 according to the first exemplary embodiment. Furthermore, only one of the two kinds of first sealing members (only the lower sealing members 81 or the upper sealing members 82) may be employed, or the second sealing member 50 may also have a function of the first sealing member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing-device housing that has an opening facing an image carrier on which an electrostatic latent image is to be formed, the developing-device housing containing developer including toner and a carrier;

a developer carrier that faces the image carrier and is rotatable while carrying the developer, the developer carrier being configured to develop the electrostatic latent image on the image carrier with the developer;

a developer-thickness-regulating member that is a substantially long magnetic member having a substantially circular sectional shape and extending parallel to an axial direction of the developer carrier, the developer-thickness-regulating member facing the developer carrier at a position on an upstream side in a direction of rotation of the developer carrier with respect to a position where the developer carrier faces the image carrier, the developer-thickness-regulating member being configured to regulate a thickness of a layer of the developer on the developer carrier at a regulating gap provided between the developer carrier and the developer-thickness-regulating member; and sealing members that seal a gap between the developer-thickness-regulating member and the developing-device housing, wherein the sealing members include first sealing members provided at two respective ends of the developer-thickness-regulating member, the ends being on respective outer sides of an effective developer-transporting area of the developer carrier, the first sealing members preventing rotation of the developer-thickness-regulating member by being in contact with the developer-thickness-regulating member at respective first portions of the gap between the developer-thickness-regulating member and the developing-device housing excluding a portion across the developer-thickness-regulating member from the regulating gap, the first sealing members sealing the respective first portions; and a second sealing member extending over an area of the developer-thickness-regulating member that corresponds to the effective developer-transporting area of the developer carrier, the second sealing member being provided at a second portion of the gap between the developer-thickness-regulating member and the developing-device housing excluding the portion across the developer-thickness-regulating member from the regulating gap, the second sealing member being in contact with the developer-thickness-regulating member at a contact pressure lower than a contact pressure at which the first sealing members are in contact with the developer-thickness-regulating member, the second sealing member sealing the second portion.

2. The developing device according to claim 1, wherein the first and second portions of the gap between the developer-thickness-regulating member and the developing-device housing that are sealed by the first and second sealing members are on a virtual line extending in a direction substantially orthogonal to the regulating gap.

3. The developing device according to claim 1, wherein the first and second sealing members are aligned in a longitudinal direction of the developer-thickness-regulating member in at least one portion of the gap between the developer-thickness-regulating member and the developing-device housing.

4. The developing device according to claim 1, wherein the first sealing members provided at the two respective ends of the developer-thickness-regulating member are each one of a plurality of first sealing members that are provided at respective positions on a circumference of the developer-thickness-regulating member in the gap between the developer-thickness-regulating member and the developing-device housing.

5. The developing device according to claim 4, wherein the first sealing members at each of the two ends of the developer-thickness-regulating member are provided at two respective positions that are on opposite sides of the developer-thickness-regulating member, and wherein the second sealing member extends over a space between two of the first sealing members that are on a downstream side in a direction of rotation of the developer carrier.

6. The developing device according to claim 1, wherein the first sealing members each have a surface characteristic that applies a frictional force to the developer-thickness-regulating member, the frictional force preventing the rotation of the developer-thickness-regulating member.

7. The developing device according to claim 1, wherein the first sealing members prevent the rotation of the developer-thickness-regulating member while being pressed by the developing-device housing.

8. An image forming apparatus comprising:

an image carrier on which an electrostatic latent image is to be formed; and the developing device according to claim 1.

9. The image forming apparatus according to claim 8, further comprising:

a cleaning device that removes residual toner from the image carrier; and a refeeding mechanism that collects the toner removed by the cleaning device and refeeds the toner toward a stirring-and-transporting member included in the developing device.

* * * * *